United States Patent [19]

Beerens et al.

[11] Patent Number: 4,505,374

[45] Date of Patent: Mar. 19, 1985

[54] APPROACH ROLLER FEED BED FOR COOLING BEDS FOR THE RETARDATION AND TRANSVERSE CONVEYANCE OF PRODUCT LENGTHS

[75] Inventors: Hügo Beerens, Meersbusch; Hugo Feldmann, Alsdorf; Theodor Gipperich, Dusseldorf; Hans Kirchhoff, Krefeld; Siegfried Küsel, Dusseldorf; Claus G. Schlanzke, Ratingen-Eckamp; Dieter Nobis, Neuss, all of Fed. Rep. of Germany

[73] Assignee: SMS Schloemann-Siemag Aktiengesellschaft, Dusseldorf, Fed. Rep. of Germany

[21] Appl. No.: 391,878

[22] Filed: Jun. 24, 1982

[30] Foreign Application Priority Data

Jul. 8, 1981 [DE] Fed. Rep. of Germany ..... 3126811

[51] Int. Cl.[3] ..... B65G 47/26

[52] U.S. Cl. ..... 198/448; 198/474; 198/614; 414/748

[58] Field of Search ..... 198/457, 474, 774, 614, 198/470, 447, 452, 360, 363, 493, 491, 690, 448; 414/748; 193/32, 40

[56] References Cited

U.S. PATENT DOCUMENTS

| | | | |
|---|---|---|---|
| 1,689,552 | 10/1928 | Kastel | 198/614 |
| 3,785,467 | 1/1974 | Takashima | 198/774 |
| 4,311,229 | 1/1982 | Bennett | 198/493 |

FOREIGN PATENT DOCUMENTS

| | | | |
|---|---|---|---|
| 692593 | 8/1964 | Canada | 414/748 |
| 602736 | 8/1934 | Fed. Rep. of Germany | 198/491 |
| 1952180 | 4/1971 | Fed. Rep. of Germany | 198/360 |
| 2319116 | 10/1974 | Fed. Rep. of Germany | 198/474 |
| 1385667 | 2/1975 | United Kingdom | 414/748 |
| 280415 | 9/1970 | U.S.S.R. | 414/748 |
| 636069 | 12/1978 | U.S.S.R. | 198/438 |

*Primary Examiner*—Joseph E. Valenza
*Assistant Examiner*—Kyle E. Shane
*Attorney, Agent, or Firm*—Holman & Stern

[57] ABSTRACT

Rolled stock running out of a rolling mill is parted into lengths suitable for the cooling bed. Rolled stock cross sections of various sizes are retarded both at approach speeds of more than approximately 20 m/sec and slower, alongside the cooling bed in an approach roller feed bed and then transversely conveyed over the cooling bed. In order to avoid requiring an uneconomically long cooling bed as a result of the sequence times of the lengths of rolled stock, three or more longitudinal braking sections are arranged side by side to enable thin lengths at a high approach speed to be retarded in rapid succession and conveyed across to the cooling bed. Covering means of the braking sections are constructed to provide additional retardation of the lengths, e.g. by blowing air, by lowering brake shoes or by the action of linear electromagnetic motors.

20 Claims, 7 Drawing Figures

17
14a
14b
14c
14
A
11
B
11a
18
15a
15
13
C
15b
15a
T
13
16
13a
16
12b
T
12
12a
T
12
12a 29
27
26
24(25)
30
28
R
T
12
12a
12b
16
25
26
15a
24
14a
T
15
13
11a
14
11

APPROACH ROLLER FEED BED FOR COOLING BEDS FOR THE RETARDATION AND TRANSVERSE CONVEYANCE OF PRODUCT LENGTHS

BACKGROUND OF THE INVENTION

1. Field Of The Invention

This invention relates to an approach roller feed bed for cooling beds for the retardation and transverse conveyance of metal lengths of varying cross sections and approach speeds, consisting of conveyor rollers inclined transversely with respect to the conveying line, a longitudinal braking section next to the cooling bed for the retardation of thick profile sections, and a longitudinal braking section, away from the cooling bed and covered by movable covering means, for the retardation and conveyance of thin profile sections. The retardation and conveyance of the lengths occurs by means of braking means which can be raised and lowered and the longitudinal sections and their braking means can be operated independently of one another.

2. Description Of The Prior Art

A device of the above named type is already disclosed in the German Auslegeschrift No. 1 289 813, in which either thick profile sections at a low approach speed or thin profile cross sections at a higher approach speed, in lengths, are retarded and conveyed to the cooling bed. The lengths of varying profile cross sections initially approach in a common channel spaced from the cooling bed and after overflow are retarded in succession in stages in two brake channels lying adjacent to one another or in the brake channel adjacent the cooling bed, and are conveyed to the cooling bed. The approach channel and the first brake channel are covered on the top with pivotable covering means in order to prevent the fast-moving lengths of thin profile sections from jumping out of the approach channel or the first brake channel. This device has the disadvantage that in particular the lengths approaching at a higher approach speed require an overflow time before the first brake channel can commence retardation.

BRIEF SUMMARY OF THE INVENTION

The object of the invention is to avoid the disadvantages of the previously known device, in particular to shorten the operating cycle of the braking means for the lengths approaching at a higher speed in two parallel lines, and thus to enable lengths with an approach speed or more than 20 m/sec to be retarded and conveyed to the cooling bed, with the same or a lesser cooling bed length. Another object of the invention is further to shorten the retardation of the lengths by the use of additional braking means.

According to the invention it is proposed that adjacent to the cooling bed three longitudinal braking sections with braking means which can be raised and lowered are arranged, of which the inner longitudinal section, next to the cooling bed, is separated from the other two sections by a narrow separation means section which can be raised and lowered, the other two longitudinal braking sections are separated from one another by a channel wall, and movable covering means are associated in each case with the longitudinal sections; when the braking means are lowered the central longitudinal section forms an approach channel for the inner braking section; and with braking means which can be raised and lowered the central and outer braking sections are jointly operable alternately with one another. The advantage of such a device is that the lengths at a high approach speed do not need to be conveyed from an approach channel into a brake channel, but can immediately run directly into one or the other of two brake channels in alternation and the retardation process can be initiated without any loss of time.

A diverter may be arranged upstream of the central and outer braking sections with the central longitudinal braking section forming an extension of the rolling line. The covering means can in each case according to the embodiment be firmly connected to the braking means, for instance the braking means simultaneously forming the covering means and being constructed as slides which can be raised and lowered. Alternatively the covering means can rise and fall or pivot independently of the braking means. Rising and falling push rods, or hydraulic or pneumatic power means, can be used as a lifting means for the covering means. The covering means of the three longitudinal sections form a sliding surface inclined towards the cooling bed. The backs of the covering means and the inner braking section can also form a sliding surface inclined towards the cooling bed. The covering means can be raised and lowered in dependence on the braking means motion, however they can also be constructed so as to be movable independently of one another. The covering means can be provided with brake shoes as additional braking means, constructed so as to pivot under the action of resilient power means. The covering means can be constructed as slides overlapping the braking means, the two longitudinal braking sections away from the cooling bed being provided with air blast ducts directed towards the braking means, as additional braking means. Air outlet ducts are associated with the air blast ducts in the region of the braking sections. Groups of linear motors can also be associated as additional braking means with the two braking sections away from the cooling bed. In this case the linear motors are placed above the braking sections so as to be raised or lowered or pivoted. The braking sections are arranged in the conveying direction in the region below the motor stators. Longitudinal sections with spacer slides are arranged adjacent to the braking means.

DESCRIPTION OF THE DRAWINGS

The invention will now be described in detail with reference to the accompanying drawings wherein.

DETAILED DESCRIPTION

Figure 1:
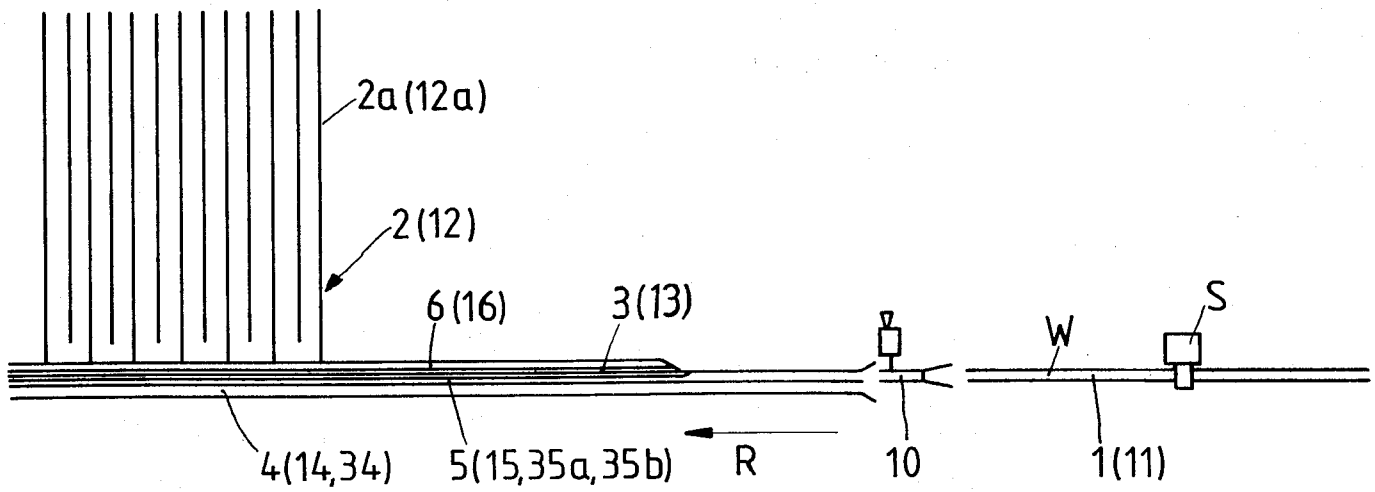
FIG. 1 is a schematic cut-away plan view of an approach roller feed bed with a cooling bed in accordance with the invention.
Figure 2:
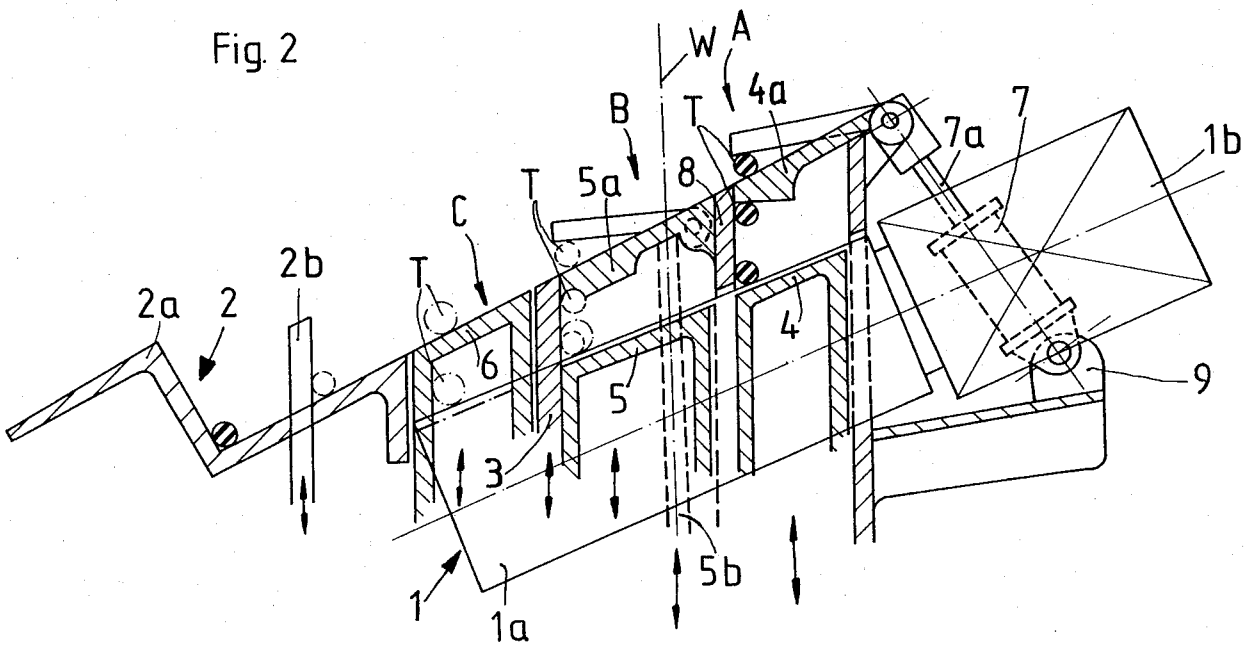
FIG. 2 is a schematic cross section of an embodiment of the approach roller feed bed of the invention.

In FIGS. 1 and 2 an approach roller feed bed is designated by 1 which is interspersed transversely with respect to the conveying direction R with conveyor rollers 1*a* inclined towards the cooling bed 2. The conveyor rollers 1*a* have individual drives 1*b*. Rolled metal stock is divided on the approach roller bed 1 by means of parting shears S into lengths T which are conveyed in succession, retarded until they are almost at a standstill and transversely conveyed into the fixed rakes 2*a* of the cooling bed 2 for further cooling. The approach roller feed bed 1 is divided into three longitudinal braking sections A, B, C lying side by side and parallel to one another, consisting of braking means 4, 5 and 6 which can be raised and lowered. The braking means 4 form an outer longitudinal section A at the side away from the cooling bed 2, with pivotable covering means 4*a*. The covering means 4*a* are hinged at one end to a piston rod 7*a* of a piston guided in a cylinder 7. The cylinder 7 is secured by hinges to a bracket 9.

The braking means 5 form a central longitudinal section B, with covering means 5*a* which can be raised and lowered by means of rams 5*b*. The braking means 6 form an inner longitudinal section C next to the cooling bed 2. The backs of the covering means 4*a* and 5*a* when lowered and the braking means 6 when raised form a slide or ramp inclined with respect to the cooling bed 2 for transversely conveying the lengths T.

The inner longitudinal section C is separated from the central longitudinal section B by a longitudinal section with separation means 3 which can be raised and lowered. The outer longitudinal section A is divided from the central longitudinal section B by a fixed channel wall 8. Brake slides known per se which can be raised and lowered form the braking means 4, 5 and 6.

A distinction must be made between the supply, retardation and transfer of lengths T of rolled stock at a high approach speed, more than about 20 m/sec, and a cross section of approximately 8 to 25 mm diameter, alternately in the longitudinal sections 4 and 5, on the one hand, and the supply, retardation and transfer of lengths T of rolled stock at a lower approach speed of less than 20 m/sec and a cross section of approximately 16 to 50 mm diameter from the longitudinal section 5 via the longitudinal section 6 on the other hand.

For instance, if the first length T runs from a rolling mill, (not illustrated) after the parting of the rolled bar into lengths T on the approach roller feed bed 1, to the conveyor rollers 1*a* at a rolling speed of more than 20 m/sec, this first length T is guided into the outer longitudinal braking section A by appropriate setting of the diverter switch 10. The braking means 4 are lowered below the upper edge of the conveyor rollers 1*a*. When the length T with a thin rolled stock cross section has run far enough into the region of the cooling bed 2, the braking means 4 are lifted and the length T is retarded. The covering means 4*a*, for instance pivotable covering plates, are then swivelled up by the piston in the cylinder 7 so that the length T slides over the upper edge of the fixed channel wall 8, over the lowered covering means 5*a* and the upper surface of the raised braking means 6 into the first notch of the fixed rakes 2*a* of the cooling bed 2. Subsequently the braking means 4 and the covering means 4*a* are again lowered. The following length T, at an approach speed of more than 20 m/sec and with a thin rolled stock cross section, is guided, by reversal of the diverter 10 in the rolling line W, into the central longitudinal braking section B. The braking means 5 are lowered below the upper edge of the conveyor rollers 1*a*. When the length T has run far enough into the region of the cooling bed 2 the braking means 5 are lifted and the length T is retarded. The covering means 5*a* are raised by lifting the rams 5*b* so that the length T is diverted over the separation means 3, located in its upper position, and the braking means 6, located in its upper position, after lifting of the vertically movable bars 2*b*, into the first notch of the fixed rakes 2*a* of the cooling bed 2.

The movable rakes (not shown) of the cooling bed 2 convey the two lengths T a space further. The bars 2*b*, the braking means 5, and the covering means 5*a* are lowered. The longitudinal braking sections A and B are now ready for a new operating cycle in which further lengths T run in succession at a high approach speed on the approach roller conveyor 1.

In contrast, if the first length T is of slow-moving relatively thick stock, for example with a rolled stock speed of less than 20 m/sec and a cross section of approximately 16 to 50 mm diameter, this first length T is guided via the diverter 10 into the central longitudinal braking section B, with braking means 5 in the lowered position. As soon as the length T has run in far enough the separation means 3 is lowered and the length T runs over on the conveyor rollers 1*a* into the region of the inner longitudinal section C of which the braking means 6 are lowered below the upper edge of the conveyor rollers 1*a*. By lifting the braking means 6 the length T is lifted from the upper surfaces of the conveyor rollers 1*a* and retarded and slides over the upper edge of the fixed rakes into the first notch of the fixed rakes 2*a* of the cooling bed 2. The movable rakes convey the length T a space further on the cooling bed 2 while the inner braking means 6 is lowered into its lower position and the separation means 3 is again lifted into its upper position. Subsequently the following length T again runs into the central longitudinal section B, as already described.

Figures 3, 3A:
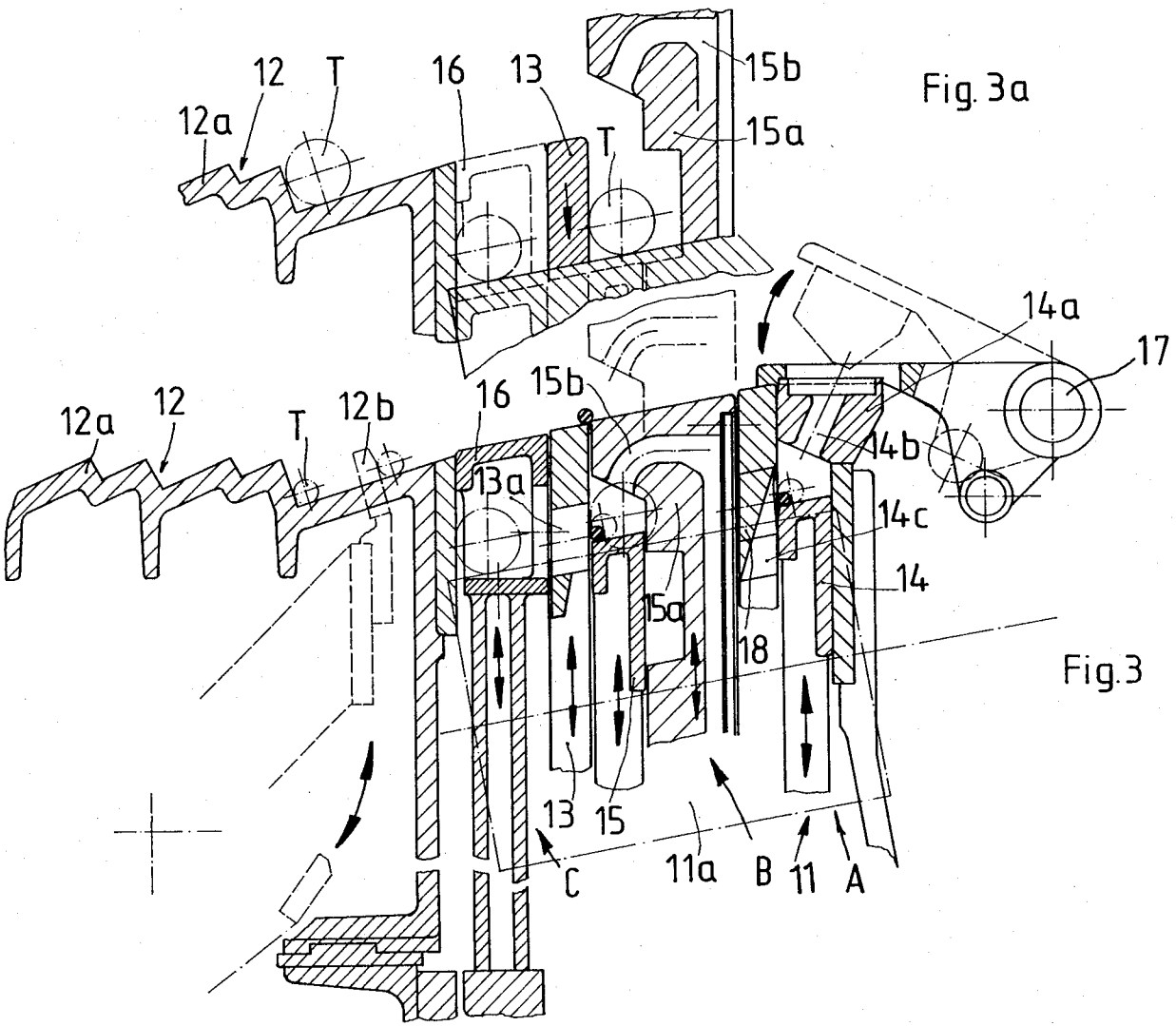
FIG. 3 is a schematic cross section of a further embodiment of the approach roller feed bed.
FIG. 3*a* is a cut-away cross section of the approach roller feed bed according to FIG. 3, set for conveying thick profile sections.

In FIGS. 3 and 3*a* a further embodiment of the approach roller feed bed with a cooling bed arranged adjacent thereto is illustrated, there being no essential difference in the method of operation with respect to FIG. 2. Elements corresponding to those shown in FIGS. 1 and 2 are identified by the same numerals increased by 10. Thus, in FIGS. 3 and 3*a* the approach roller feed bed with conveyor rollers 11*a* is designated by 11, the conveyor rollers 11*a* being arranged transversely with respect to the conveying direction R and inclined towards the cooling bed 12. The conveyor rollers 11*a* also have individual drives and are interspersed in the approach roller feed bed 11. On the approach roller feed bed 11 rolled stock of varying cross sections and profile form is divided into lengths T which are successively supplied, retarded and transversely conveyed, for further cooling, into the fixed rakes 12*a* of the cooling bed 12.

The approach roller feed bed 12 is divided into three longitudinal sections A, B, C lying parallel to one another, consisting of braking means which can be raised and lowered. The outer braking means 14 form the longitudinal section A away from the cooling bed 12, pivotable covering means 14*a* for the braking channel being associated with the longitudinal section A in order to prevent the lengths T from jumping out. The covering means 14*a* are pivotable at one end by means of a rocking shaft 17. In the covering means 14*a* air ducts 14*b* are provided, directed onto the length T in order to produce pressure forces as additional braking means by the action of the air blast so that the length T is urged into the left corner of the channel and thus on the one hand the coefficient of friction is increased during retardation and on the other hand quieter running of the length T is caused.

The braking means 15 forms the central longitudinal section B with which slides 15*a*, which can be raised and lowered and having covering means, are associated. The slides 15*a* overlap the braking means 15 and close the braking channel at the top with the covering means in order to prevent the lengths T from jumping out upwardly when they are conveyed thereto. Air ducts 15*b* directed at the length T are formed in the slides 15*a* through which air ducts 15*b* air is blown onto the lengths T so that an additional pressing force is exerted on the latter against the lower and lateral guide surfaces during retardation. The central longitudinal section 15, 15*a* is separated from the longitudinal section 14, 14*a* by a channel wall 18 and from the inner longitudinal section C with braking means 16 by means of a longitudinal section with separation means 13 which can be raised and lowered. Air ducts 13*a* are provided in the separation means 13 of the longitudinal section to extract the blast air.

Figures 4, 4A:
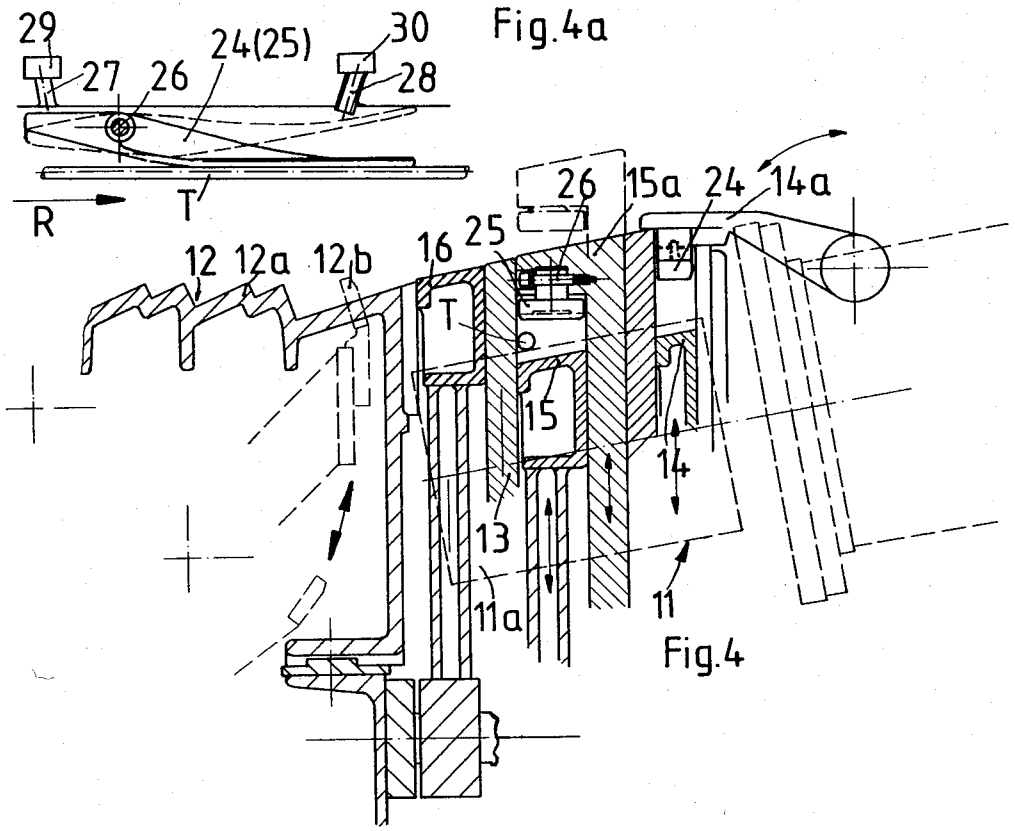
FIG. 4 is a schematic cross section showing the covering means and air brakes as additional braking means.
FIG. 4*a* shows the air brakes of FIG. 4 in elevation.

Instead of the air ducts 14*b*, 15*b* as additional braking means, pivotably mounted brake shoes 24 can also be arranged on the lower side of the covering means 14*a*, 15*a* as shown in FIG. 4.

The braking means 16 are C-shaped and in the raised position simultaneously form the covering means. The backs of the covering means 14*a*, 15*a* when lowered and the braking means 16 when raised form a ramp or slide inclined towards the cooling bed 12 for transversely conveying the lengths T. Braking shoes or slides known per se which can be raised and lowered form the longitudinal sections with braking means 14, 15 and 16.

The operation of the apparatus shown in FIGS. 3 and 3*a* is analogous to that of FIG. 2. In the case of lengths T of rolled stock with an approach speed of more than approximately 20 m/sec and a cross section of approximately 8 to 25 mm, the first length T runs from a rolling mill, after parting into lengths T, on the approach roller feed bed 11, and is guided into the outer longitudinal braking section A. The braking means 14 are lowered below the upper surfaces of the conveyor rollers 11*a*. After the length T has run far enough into the region of the cooling bed, the braking means 14 are lifted and the length T is retarded. The covering means 14*a*, for instance pivotable covering plates, are swivelled up by operation of the rocking shaft 17 so that the length T is diverted over the upper edge of the fixed channel wall 18 and over the lowered covering means 15*a* and the top of the lifted braking means 16 into the first notch of the fixed rakes 12*a* of the cooling bed 12. Subsequently the braking means 14 and the covering means 14*a* are again lowered. The following length T is guided, after reversal of the diverter 10, into the central longitudinal section B, with the braking means 15 lowered below the upper surface of the conveyor rollers 11*a*. After the length T has run far enough into the region of the cooling bed 12 the braking means 15 are lifted and the length T is retarded. The covering means 15*a* are raised by lifting the T-shaped slide so that the length T is diverted, over the separation means 13 located in its upper position and the back of the lifted braking means 16, after lifting the bars 12*b*, into the first notch of the fixed racks 12*a* of the cooling bed 12.

The movable rakes of the cooling bed 12 convey the two lengths T a space further. The bars 12*b*, the braking means 15, and the covering means 15*a* are then again lowered. The longitudinal braking sections A, B are then ready for a new operating cycle in which further lengths T approach the approach roller feed bed 11 at a high approach speed. If the lengths T approaching the braking means 14 or 15 are to be subjected to a braking force additional to the braking forces exerted when the braking means 14, 15 are lifted, air is blown through the air ducts 14*b* or 15*b* onto the length T which is running in, the air pressure forces causing an increased frictional force on the sliding surfaces guiding the length T. Apart from a further shortening of the braking path, additional quiet running of the lengths T approaching at a high speed is also obtained when compressed air is blown on. The air is drawn off downwardly by air ducts 14*c* or 13*a* laterally of the conveyor rollers 11*a*.

In the case of rolled parted lengths T with a rolled stock speed of less than 20 m/sec and a cross section of approximately 16 to 50 mm diam, a length T is guided by the diverter 10 into the longitudinal section B, with braking means 15 in the lowered position. The slide, overlapping the braking means 15, of the covering means 15*a* is lifted, as shown in FIG. 3*a*, so that the free space above the braking means 15 is extended for the thick cross sections. The braking means 16 is lowered below the conveying plane. When the length T has run into the region of the cooling bed 12, the initially raised separation means 13 is lowered and the length T shifts on the conveyor rollers 11*a* into the region of the inner longitudinal section C with braking means 16 lowered. By lifting the braking means 16 the length T is lifted from the conveyor rollers 11*a*, is retarded and slides over the upper edge of the fixed rakes 12*a* of the cooling bed 12. The movable rakes convey the length T a space further on the cooling bed 12 while the braking means 16 is lowered and the separation means section 13 is again lifted. Subsequently the following length T runs into the longitudinal section B.

In FIGS. 4 and 4*a* a further embodiment of the approach roller feed bed is illustrated. Parts corresponding to those in FIG. 4 have the same reference numbers. The covering means 14*a* and 15*a* are constructed so as to be raised and lowered or pivoted as described above. Additional brake shoes 24, 25 are pivotably secured to the covering means 14*a* and 15*a*, on their sides facing the braking means 14, 15. The brake shoes 24, 25 are secured by a suspension pin 26 approximately at their center of gravity, to the covering means 14*a*, 15*a* approximately in the horizontal plane parallel to the conveying line R. In order to influence the horizontal position of the brake shoes when a length T runs in or through, compressed air can be blown onto either end of the brake shoes 24, 25 by means of air nozzles 27, 28. The air nozzles 27, 28 are arranged in the covering means 14*a* and 15*a* above the free ends of the brake shoes 24, 25 and can be controlled by valves 29, 30.

As soon as the leading end of a length T passes the longitudinal section with brake shoes 24 or 25, the valves 29 are opened so that air is blown through the air nozzles 27 onto the front (downstream) end of the brake shoes 24, 25 so that the rear (upstream) end of the brake shoes 24 or 25, as illustrated by broken lines, is slightly raised and the leading end of the length T passing through is not obstructed by the brake shoes 24 or 25, even in the case of unquiet running. When the leading end of the length T has run through, the air nozzles 27 are turned off by reversing the associated valve 29 so that the supply of air is interrupted. The valve 30 associated with the air nozzles 28 is then opened and the air nozzles 28 are supplied with blast air, and the rear ends of the brake shoes 24 or 25 bear on the surface of the lengths T and exert an additional braking force upon the latter. The intensity of the additional braking can be influenced by altering the pressure of the air blown onto the rear ends of the brake shoes 24 or 25. The action of the brakes 24 or 25 on the length T passing through is in addition to the braking force exerted by the braking means 14 or 15 in the manner described above.

Instead of the air nozzles 29, 30 other resilient means such as springs or electromagnets can also be associated with the brake shoes 24 or 25. The brake shoes 24 or 25 can be pivotably suspended on parallelogram links.

Figure 5:
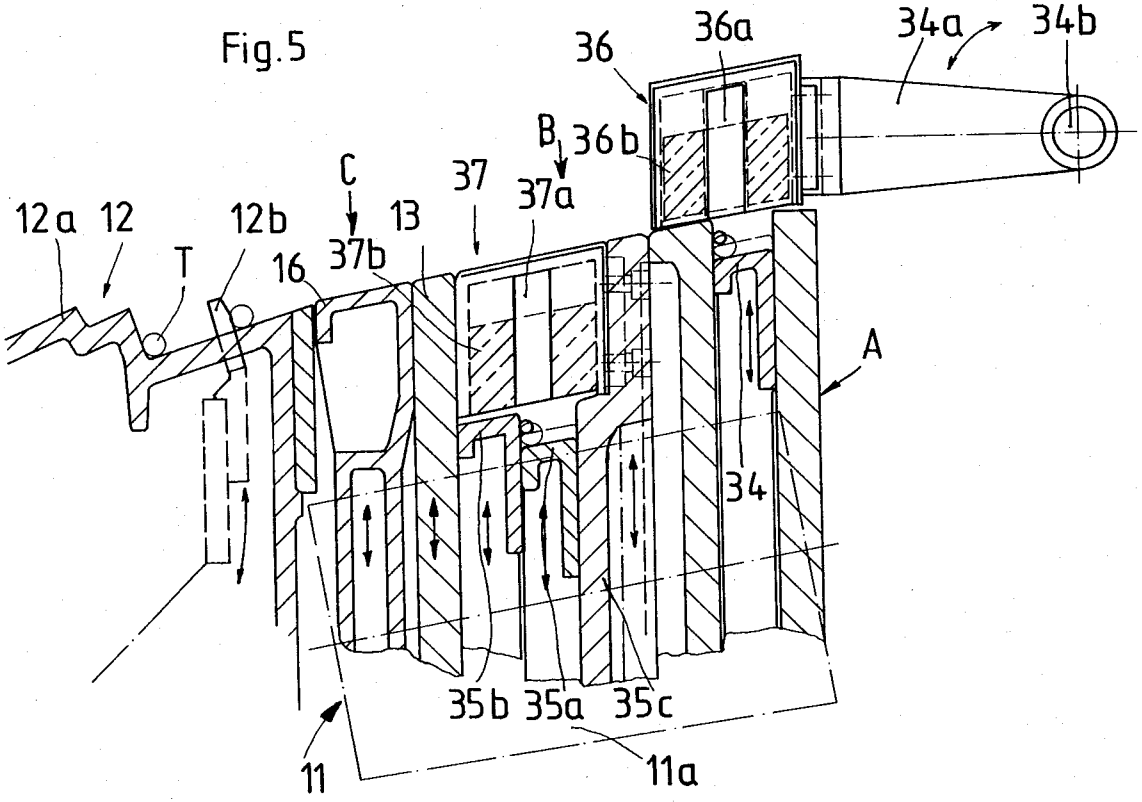
FIG. 5 is a schematic cross section showing an embodiment of the covering means with linear motors as additional braking means.

In a further embodiment according to FIG. 5 the covering means associated with the longitudinal braking sections having braking means 34 or 35*a* are constructed as linear electric motors 36 or 37. The linear motors 36 are secured to rocking levers 34*a* movable about pivot shafts 34*b* while the linear motors 37 are laterally connected to slides 35*c* which can be raised and lowered. The linear motors 36 and 37 have stators 36*a* and 37*a* conducting the magnetic flux (electromagnetic travelling field) on which are seated windings 36*b* and 37*b* which are offset with respect to one another. The linear motors 36, 37 are surrounded by housings. Below the stator 36*a* or 37*a* is a respective longitudinal braking section with braking means 34 and 35*a* which can be raised and lowered and which simultaneously forms the return plate for the magnetic flux. Guide plates which do not conduct the magnetic flux are arranged to the side of the braking means section 34 in the conveying direction R below the cross sections of the windings 36*b*. To the side of the braking means section 35*a* in the conveying direction R below the cross sections of the windings 37*b* are a longitudinal section with spacer slides 35*b* which can be raised and lowered and a bar on the slide 35*c*, which consist of a material, for instance cast iron, which does not conduct the magnetic flux.

If, as already described above with respect to FIGS. 2 and 3, rolled length T with a thin cross section and an approach speed of more than 20 m/sec runs on the conveyor rollers 11*a* of the approach roller feed bed 11 via the diverter 10 into the braking section A, the latter is lifted with its upper edge above the conveying plane of the conveying rollers 11*a*, until the length T is in the region of the air gap which extends between the lower edge of the stator 36*a* of the linear motor 36 and the upper edge of the braking means 34. The linear motors 36 are then switched on so that an electrical alternating voltage is applied to the magnetic coils 36*b* and the magnet coils 36*b* produce an electromagnetic travelling field which exerts a magnetic force in the length T opposite to the conveying direction R which results in an additional braking action in addition to the retardation of the length T caused by the sliding friction on the braking means 34. Moreover the magnetic field brings about quieter running of the length T. As soon as the length T has been sufficiently retarded the linear motors 36 are turned off and swivelled out upwardly around the swivel axis 34*b*, and the braking means 34 is further lifted to the upper edge of the lateral guides so that the length T slides down the sliding surface inclined towards the cooling bed 12, into the first notch of the cooling bed 12. Subsequently the braking means 34 and the linear motors 36 are moved back into their initial position.

After the reversal of the diverter 10 the following length T with a thin cross section and an approach speed of more than 20 m/sec is conveyed on the approach roller feed bed 11 into braking section B. While the spacer slide section 35*b* has already been lifted to below the upper edge of the part of the magnet coil 37*b* nearer the cooling bed, by lifting the braking means 35*a* above the upper surface of the conveyor rollers 11*a* the length T is lifted to the region of the air gap between the lower edge of the stator 37*a* and the upper edge of the braking means 35*a* indicated by broken lines. In this case the length T is retarded as a result of the sliding friction and by switching on the linear motors 37 a magnetic travelling field is produced in the windings of the linear motors 37 by the applied a.c. voltage, the magnetic travelling field producing in the length T a magnetic force in the opposite direction to the conveying direction. Moreover quieter running of the length T is obtained by the magnetic field. The slide section 35*c* bearing the linear motors 37 is lifted to the extent that with the further lifting of the braking means 35*a* and the spacer slide section 35*b* to the upper edge of the sliding ramp surface inclined towards the cooling bed 12 the length T can slide off into the following notch of the cooling bed 12. Subsequently the braking means 35*a*, the spacer slide 35*b* and the slide 35*c* bearing the linear motors 37 are again moved back into their initial positions.

The braking means which can be raised and lowered, and the separation means as well as the other slides mentioned, are pivotably mounted in a known manner preferably on an axis X arranged below the slide and transverse with respect to the conveying direction R, and are actuated by way of pull or push rods (not illustrated).

The motion of the covering means by swivelling or lifting or lowering can occur in dependence on the motion of the associated braking means or independently thereof.

In a known way, it is also possible with the devices illustrated to lift out the lengths T from the inner braking sections C by means of the movable rakes.

It is also conceivable to provide three or more braking sections for the retardation of the lengths T at a high approach speed (more than 20 m/sec) instead of two braking sections A, B.

Finally it would also be possible to retard the lengths T, when the covering means 4*a*, 5*a*; 14*a*, 15*a* are closed and when the braking means 4, 5; 14, 15 are lowered, by the braking means 6, 16 and to convey the lengths T to the cooling bed 2, 12; the channel wall 8, 18 as well as the separation means 3, 13 would have to be constructed so as to be raised and lowered.

We claim:

1. In an approach roller feed bed for cooling beds for lengths of product of varying cross-sections and approach speeds, in which a strand of rolled stock, divided into lengths, is fed in an axial direction, including conveyor rollers inclined transversely with respect to the conveying line, the feed bed being divided into an inner longitudinal section adjacent the cooling bed for the retardation and transverse conveyance of thick profile cross-sections, and a longitudinal section spaced from the cooling bed and covered by movable covering means for the retardation and transverse conveyance of thin profile cross-sections, the longitudinal sections having braking means which may be raised and lowered independently of one another for retarding and conveying the lengths, the improvement comprising:

three longitudinal retarding and transverse conveying sections forming three substantially parallel longitudinal channels substantially aligned with the longitudinal axis of the conveying line, comprised of an inner channel adjacent the cooling bed, a central channel adjacent said inner channel and an outer channel adjacent said central channel on the side opposite said inner channel, said channels being disposed in the region within the width of the conveyor rollers;

braking means in each channel beteen said conveyor rollers;

means to raise and lower said braking means between a raised position above the upper surfaces of said rollers to lift the rolled stock length off said rollers and retard their axial travel, and a lower position below the upper surface of said rollers;

a first channel wall separating means between said inner and central channels;

means to raise and lower said first separating means between a raised position above the upper surface of said rollers and a lower position below the upper surface of said rollers;

a second channel wall separation means between said central and outer channels;

movable covering means for each said central and outer channels;

means to open and close said covering means;

said central channel forming an approach channel for said inner channel when said braking means of said central channel is in the lower position; and said braking means for said central and outer channels being operable alternately to transversely convey said lengths of rolled stock toward said inner channel.

2. An approach roller feed bed according to claim 1, and further comprising a diverter arranged in the conveying line upstream of said central and outer channels for alternately directing said lengths of rolled stock into said central and outer channels.

3. An approach roller feed bed according to claim 1 wherein said central channel forms an extension of the product rolling line.

4. An approach roller feed bed according to claim 1, wherein the braking means of the inner channel comprises integral covering means for said inner channel when in the raised position.

5. An approach roller feed bed according to claim 4, wherein the braking means of the inner channel comprise slides having a C-shaped cross-section which can be raised and lowered.

6. An approach roller feed bed according to claim 1, wherein the covering means of the central and outer channels are pivotably mounted at one edge thereof.

7. An approach roller feed bed according to claim 6, wherein said means to open and close the covering means of the central channel comprises a push rod to operate the covering means about its pivot axis.

8. An approach roller feed according to claim 6, wherein said means to open and close the covering means of said outer channel comprises a fluid-actuated means for raising and lowering the covering means about its pivot axis.

9. An approach roller feed bed according to any one of the preceding claims wherein the covering means of the central channel and the braking means of the inner channel in the raised position form a sliding surface inclined towards the cooling bed.

10. An approach roller feed bed according to any one of claims 1 to 8 wherein the covering means are operatively associated with said braking means to be opened and closed in dependence on the movement of the braking means.

11. An approach roller feed bed according to any one of claims 1 to 8 wherein the braking means and the covering means are movable independently of one another.

12. An approach roller feed bed according to any one of claims 1 to 8 and further comprising brake shoes mounted on the covering means so that they are engageable with the lengths of rolled stock as additional braking means.

13. An approach roller feed bed according to claim 12 wherein said brake shoes are pivotable in the respective central and outer channels and against the product conveying direction under the action of a resilient force.

14. An approach roller feed bed according to any one of claims 1 to 8 wherein the covering means of at least one said central and outer channels are constructed as slides overlapping the associated braking means.

15. An approach roller feed bed according to any one of claims 1 to 8 wherein the covering means of the central and outer channels are provided with air blowing ducts adapted to blow air under pressure directed towards the braking means as additional braking means.

16. An approach roller feed bed according to claim 15 and further comprising air exhaust ducts associated with the air blowing ducts provided in said separating means.

17. An approach roller feed bed according to any one of claims 1 to 8 and further comprising linear electromagnetic motors on said conveying means adapted to produce a magnetic force in the direction opposite to the product conveying direction in said central and outer channels as additional braking means.

18. An approach roller feed bed according to claim 17 wherein said linear motors are associated with and arranged above the braking means of said central and outer channels and are adapted to be raised and lowered with respect thereto.

19. An approach roller feed bed according to claim 17 wherein said linear motors are associated with the braking means of the central and outer channels which are arranged in the conveying direction in the region below the stators of the said linear motors.

20. An approach roller feed bed according to claim 19, and further comprising longitudinal sections with spacer slides are associated with the braking means.

* * * * *